US007673397B2

(12) United States Patent
Jarvis

(10) Patent No.: US 7,673,397 B2
(45) Date of Patent: Mar. 9, 2010

(54) ARTICLE OF FOOTWEAR WITH SUPPORT ASSEMBLY HAVING PLATE AND INDENTATIONS FORMED THEREIN

(75) Inventor: Kelly B. Jarvis, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 971 days.

(21) Appl. No.: 11/381,593

(22) Filed: May 4, 2006

(65) Prior Publication Data

US 2007/0256326 A1 Nov. 8, 2007

(51) Int. Cl.
*A43B 13/18* (2006.01)

(52) U.S. Cl. ..... 36/28; 36/35 R; 36/25 R

(58) Field of Classification Search ..... 36/25 R, 36/28, 30 R, 35 R, 114
See application file for complete search history.

(56) References Cited

U.S. PATENT DOCUMENTS 4,151,661 A * 5/1979 Namba et al. ..... 36/30 R
4,183,156 A 1/1980 Rudy
4,219,945 A 9/1980 Rudy
4,255,877 A 3/1981 Bowerman
4,287,675 A 9/1981 Norton et al.
4,288,929 A 9/1981 Norton et al.
4,354,318 A 10/1982 Frederick et al.
4,364,188 A 12/1982 Turner et al.
4,364,189 A 12/1982 Bates
4,492,046 A 1/1985 Kosova
4,559,724 A 12/1985 Norton
4,566,206 A 1/1986 Weber
4,949,476 A 8/1990 Anderie
5,159,767 A 11/1992 Allen
5,203,095 A 4/1993 Allen
5,247,742 A 9/1993 Kilgore et al.
5,337,492 A * 8/1994 Anderie et al. ..... 36/28
5,343,639 A 9/1994 Kilgore et al.
5,353,523 A 10/1994 Kilgore et al.
5,367,790 A 11/1994 Gamow et al.
5,572,804 A * 11/1996 Skaja et al. ..... 36/29
5,701,686 A 12/1997 Herr et al.
6,029,374 A 2/2000 Herr et al.

(Continued)

FOREIGN PATENT DOCUMENTS

CN 1750771 A 3/2006

(Continued)

OTHER PUBLICATIONS

Patent Cooperation Treaty International Search Report-PCT/US2007/067186.

(Continued)

*Primary Examiner*—Marie Patterson
(74) *Attorney, Agent, or Firm*—Banner & Witcoff, Ltd.

(57) ABSTRACT

An article of footwear includes an upper and a sole assembly secured to the upper. The sole assembly includes a top plate and a bottom plate spaced from the top plate. A central member is positioned between the top plate and bottom plate and includes a plurality of elastomeric support columns. A plurality of indentations is formed in a lower surface and along a periphery of the central member, with each indentation extending upwardly into an elastomeric support column. A plurality of raised portions is positioned along a periphery of the bottom plate, with each raised portion being nested in an indentation in the central member.

42 Claims, 3 Drawing Sheets

U.S. PATENT DOCUMENTS

| | | | | |
|---|---|---|---|---|
| 6,055,747 | A * | 5/2000 | Lombardino | 36/37 |
| 6,082,024 | A * | 7/2000 | Del Biondi | 36/28 |
| 6,314,664 | B1 | 11/2001 | Kita et al. | |
| 6,449,878 | B1 | 9/2002 | Lyden | |
| 6,568,102 | B1 * | 5/2003 | Healy et al. | 36/28 |
| 6,598,320 | B2 * | 7/2003 | Turner et al. | 36/28 |
| 6,601,042 | B1 | 7/2003 | Lyden | |
| 6,694,642 | B2 * | 2/2004 | Turner | 36/28 |
| 6,851,204 | B2 * | 2/2005 | Aveni et al. | 36/28 |
| 6,880,267 | B2 * | 4/2005 | Smaldone et al. | 36/28 |
| 6,968,636 | B2 * | 11/2005 | Aveni et al. | 36/28 |
| 7,082,698 | B2 * | 8/2006 | Smaldone et al. | 36/28 |
| 7,444,767 | B2 * | 11/2008 | Kilgore et al. | 36/30 R |
| 2003/0061731 | A1 * | 4/2003 | Turner et al. | 36/28 |
| 2003/0069807 | A1 | 4/2003 | Lyden | |
| 2003/0177666 | A1 | 9/2003 | Nakano et al. | |
| 2004/0128860 | A1 * | 7/2004 | Smaldone et al. | 36/28 |
| 2004/0181969 | A1 * | 9/2004 | Smaldone et al. | 36/28 |
| 2004/0261292 | A1 * | 12/2004 | Aveni et al. | 36/28 |
| 2005/0217145 | A1 | 10/2005 | Miyauchi et al. | |
| 2005/0278980 | A1 * | 12/2005 | Berend et al. | 36/103 |
| 2006/0112592 | A1 * | 6/2006 | Leedy et al. | 36/29 |
| 2006/0137277 | A1 | 6/2006 | Kenjiro et al. | |
| 2007/0033831 | A1 * | 2/2007 | Aveni | 36/28 |

FOREIGN PATENT DOCUMENTS

| | | |
|---|---|---|
| DE | 9210113 | 9/1992 |
| EP | 1264556 | 12/2002 |
| EP | 1386553 | 2/2004 |
| WO | 03043455 | 5/2003 |
| WO | 2006093697 | 9/2006 |

OTHER PUBLICATIONS

PCT/US2007/067186—Partial International Search Report dated Apr. 23, 2007.

Office Action issued Oct. 16, 2009 in corresponding Chinese Patent Application No: 200780014862.8, and English translation thereof.

* cited by examiner

ARTICLE OF FOOTWEAR WITH SUPPORT ASSEMBLY HAVING PLATE AND INDENTATIONS FORMED THEREIN

FIELD OF THE INVENTION

This invention relates generally to an article of footwear and, in particular, to an article of footwear with a support assembly having a plate and indentations formed therein.

BACKGROUND OF THE INVENTION

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide traction and control foot motions, such as pronation. The upper and sole structure provide lateral stability for cutting and side to side movements encountered in sporting activities such as basketball. Accordingly, the upper and the sole structure operate cooperatively to provide a comfortable structure that is suited for a variety of ambulatory activities, such as walking, running, cutting and jumping.

The sole structure of athletic footwear generally exhibits a layered configuration that may include a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane, which compress resiliently under an applied load to attenuate ground reaction forces created by the impacts of running and jumping. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities. The compression of the foam is affected by hysteresis loss, and deflection of such systems is affected by the volume of the compressed mass of the midsole. Elastomeric support columns may be provided in the midsole to provide additional support and stiffness in desired areas of the sole structure.

It would be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear having elastomeric support columns and indentations formed therein. In accordance with a first aspect, an article of footwear includes an upper and a sole assembly secured to the upper. The sole assembly includes a top plate and a bottom plate spaced from the top plate. A central member is positioned between the top plate and bottom plate and includes a plurality of elastomeric support columns. A plurality of indentations is formed in a lower surface and along a periphery of the central member, with each indentation extending upwardly into an elastomeric support column. A plurality of raised portions is positioned along a periphery of the bottom plate, with each raised portion being nested in an indentation in the central member.

In accordance with another aspect, an article of footwear includes an upper and a sole assembly secured to the upper and having a top plate and a bottom plate spaced from the top plate. A central member is positioned between the top plate and bottom plate and includes a plurality of elastomeric support columns, with each elastomeric support column having a circumferential groove formed in its exterior surface. Each of a plurality of rings is seated in a corresponding circumferential groove. A plurality of indentations is formed in a lower surface and along a periphery of the central member, with each indentation extending upwardly into an elastomeric support column. Each of a plurality of raised portions is positioned along on a periphery of the bottom plate, with each raised portion being nested in an indentation in the central member. An outsole is secured to a lower surface of the bottom plate. Each of a plurality of raised portions is positioned along a periphery of the outsole, with each raised portion of the outsole being nested in a raised portion of the bottom plate.

In accordance with a further aspect, an article of footwear includes an upper and a sole assembly secured to the upper and having a top plate with a plurality of upwardly extending flanges positioned about a periphery thereof. Each flange includes a recess in a lower surface thereof. A bottom plate is spaced from the top plate and has a flange extending upwardly from a rear of the bottom plate. A central member is positioned between the top plate and bottom plate and includes a plurality of elastomeric support columns and a flange extending upwardly from a rear of the central member. Each elastomeric support column has a circumferential groove formed in its exterior surface, with an upper portion of each elastomeric support column being received in a recess of the top plate. Each of a plurality of rings is seated in a corresponding circumferential groove. Each of a plurality of indentations is formed in a lower surface and along a periphery of the central member, with each indentation extending upwardly into an elastomeric support column. Each of a plurality of raised portions is positioned along a periphery of the bottom plate, with each raised portion being nested in an indentation in the central member. An outsole is secured to a lower surface of the bottom plate and has a flange extending upwardly from a rear thereof. Each of a plurality of raised portions is positioned along a periphery of the outsole, with each raised portion of the outsole being nested in a raised portion of the bottom plate.

In accordance with yet another aspect, an article of footwear includes an upper and a sole assembly secured to the upper. The sole assembly includes a midsole and a plurality of indentations formed in a lower surface and along a periphery of the midsole. A bottom plate is positioned beneath the midsole. A plurality of raised portions is positioned along a periphery of the bottom plate, with each raised portion being nested in an indentation in the midsole.

In accordance with yet a further aspect, an article of footwear includes an upper and a sole assembly secured to the upper. The sole assembly includes a midsole and a plurality of indentations formed in a lower surface and along a periphery of the midsole. A bottom plate is positioned beneath the midsole. A plurality of first raised portions is positioned along a periphery of the bottom plate, with each raised portion being nested in an indentation in the midsole. An outsole is positioned beneath the bottom plate. A plurality of second raised portions is positioned along a periphery of the outsole, with each second raised portion being nested in a first raised portion in the midsole.

Substantial advantage is achieved by providing an article of footwear having a support assembly with a plate and indentations formed therein. In particular, certain embodiments provide flex points in the article of footwear that help with foot strike transition from heel to toe. Additionally, the perimeter of the footwear is more adaptive under edge loading and exhibits improved lateral transition. Stability of the elastomeric support columns is improved, providing enhanced support and performance. Further, certain embodiments enhance lateral stability for cutting and side to side movements encountered in sporting activities such as basketball.

These and additional features and advantages disclosed here will be further understood from the following detailed disclosure of certain embodiments.

Figure 1:
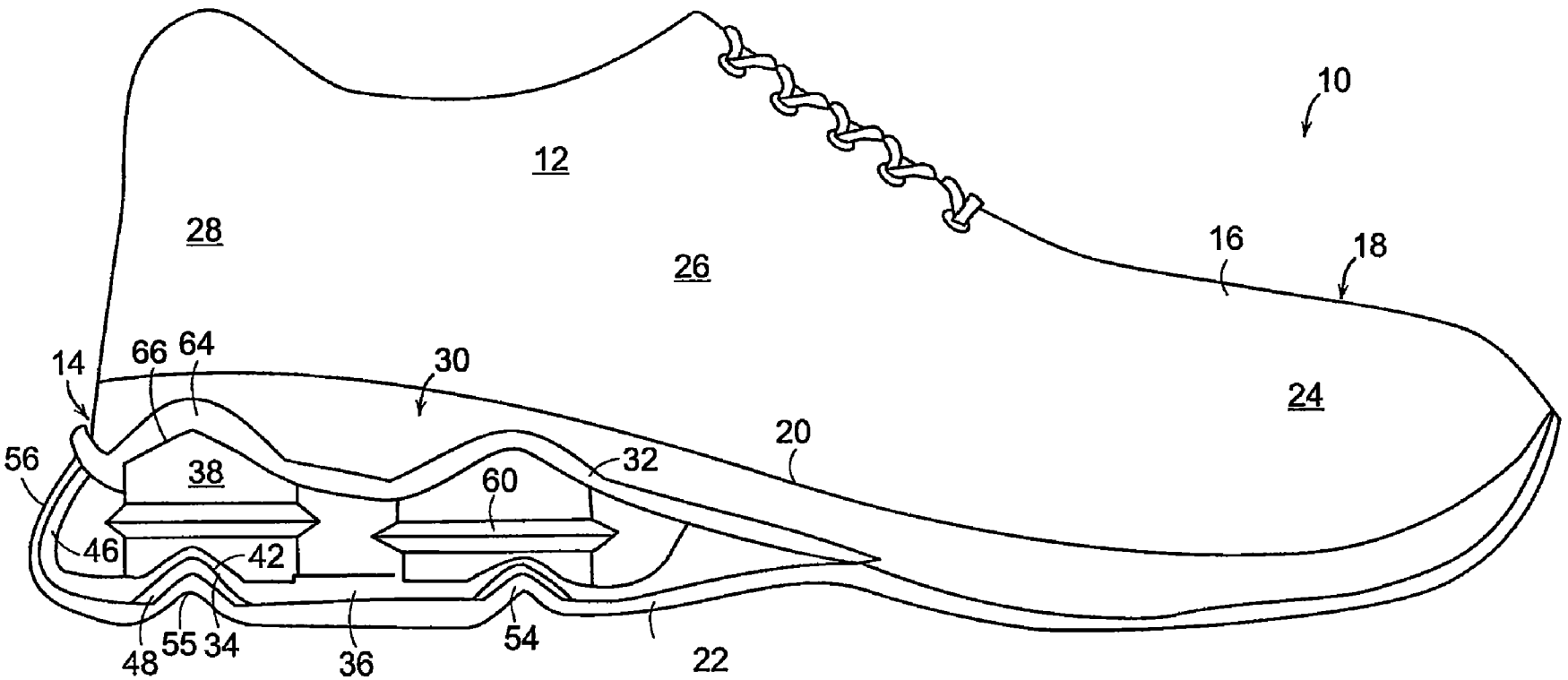
FIG. 1 is an elevation view of an article of footwear with a support assembly having elastomeric support columns.

The figures referred to above are not drawn necessarily to scale and should be understood to provide a representation of the invention, illustrative of the principles involved. Some features of the article of footwear depicted in the drawings have been enlarged or distorted relative to others to facilitate explanation and understanding. The same reference numbers are used in the drawings for similar or identical components and features shown in various alternative embodiments. Articles of footwear as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear 10 is shown in FIG. 1. Footwear 10 includes an upper 12 and a sole assembly 14 secured to upper 12. Sole assembly 14 may be secured to upper 12 by adhesive or any other suitable means. Footwear 10 has a medial, or inner, side 16 and a lateral, or outer, side 18.

Upper 12 forms an interior void that comfortably receives a foot and secures the position of the foot relative to sole assembly 14. The configuration of upper 12, as depicted, is suitable for use during athletic activities, e.g., running and basketball. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Sole assembly 14, which is generally disposed between the foot of the wearer and the ground, provides attenuation of ground reaction forces (i.e., imparting cushioning), traction, and may control foot motions, such as pronation. Sole assembly 14 can enhance lateral stability for cutting and side to side movements encountered in sporting activities such as basketball. As with conventional articles of footwear, sole assembly 14 may include an insole (not shown) located within upper 12, a midsole 20, and an outsole 22.

Midsole 20 is attached to upper 12 and functions as the primary shock-attenuating and energy-absorbing component of footwear 10. Midsole 20 may be secured to upper 12 by adhesive or other suitable means. Outsole 22 is attached to the lower surface of midsole 20 by adhesive or other suitable means. Suitable materials for outsole 22 include traditional rubber materials. Other suitable materials for outsole 22 will become readily apparent to those skilled in the art, given the benefit of this disclosure. In certain embodiments, sole assembly 14 may not include an outsole layer separate from midsole 20 but, rather, the outsole may comprise a bottom surface of midsole 20 that provides the external traction surface of sole assembly 14.

For purposes of general reference, as illustrated here, footwear 10 may be divided into three general portions: a forefoot portion 24, a midfoot portion 26, and a heel portion 28. Portions 24, 26, and 28 are not intended to demarcate precise areas of footwear 10. Rather, portions 24, 26, and 28 are intended to represent general areas of footwear 10 that provide a frame of reference during the following discussion.

Unless otherwise stated, or otherwise clear from the context below, directional terms used herein, such as rearwardly, forwardly, top, bottom, inwardly, downwardly, upwardly, interior, exterior, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 28, that is, to the left as seen in FIG. 1. Naturally, forwardly is toward forefoot portion 24, that is, to the right as seen in FIG. 1, and downwardly is toward the bottom of the page as seen in FIG. 1. Top refers to elements toward the top of the page as seen in FIG. 1, while bottom refers to elements toward the bottom of the page as seen in FIG. 1. Inwardly or interior is toward the center of footwear 10, and outwardly or exterior is toward the outer peripheral edge of footwear 10.

Figure 2:
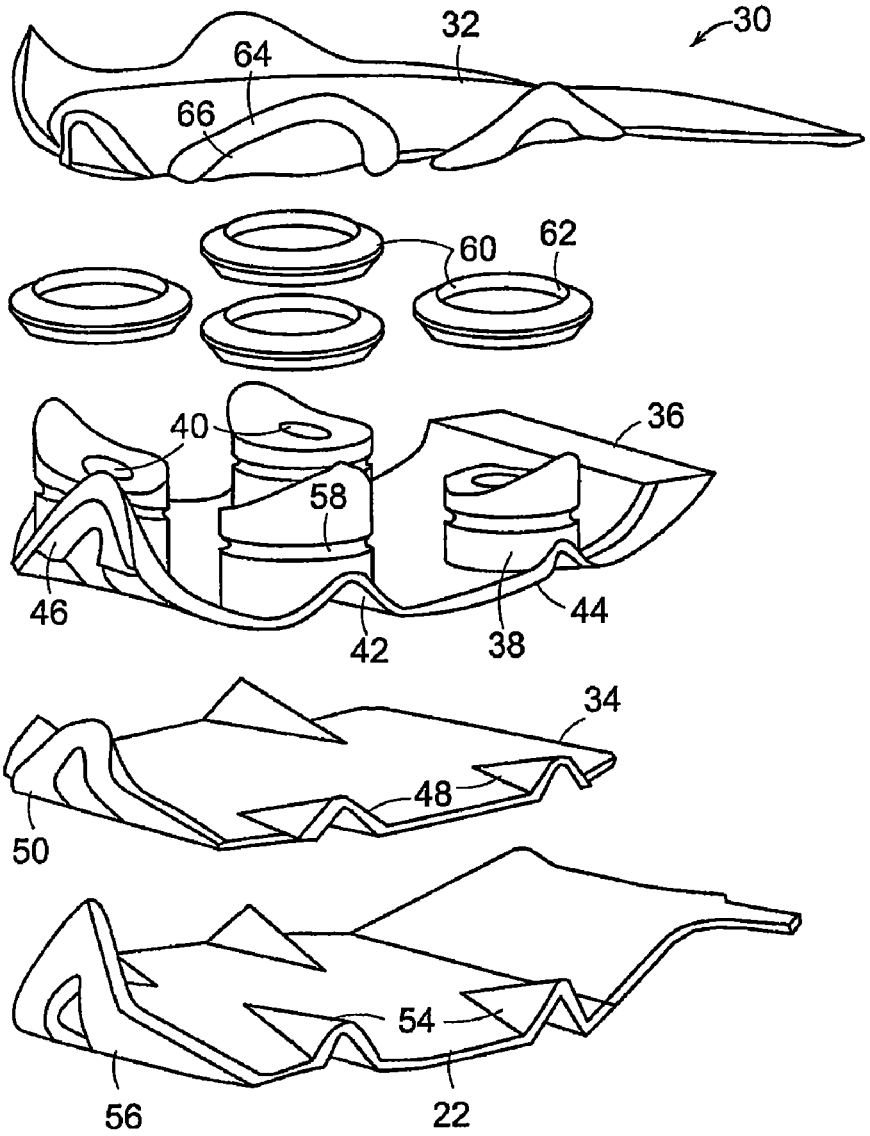
FIG. 2 is a perspective view in exploded form of the support assembly of the article of footwear of FIG. 1.

Sole assembly 14 includes a support assembly 30, positioned beneath midsole 20 in the illustrated embodiment and seen more clearly in FIG. 2. Support assembly 30 includes a top plate 32, a bottom plate 34 spaced from top plate 32, and a central member 36 positioned between top plate 32 and bottom plate 34. Support assembly 30 is positioned in heel portion 28 of sole assembly 14 in the illustrated embodiment. It is to be appreciated that support assembly 30 can be positioned anywhere within sole assembly 14. Thus, support assembly 30 may, for example, be positioned alternatively in midfoot portion 26 or forefoot portion 24, or in any combination of forefoot portion 24, midfoot portion 26 and heel portion 28.

In certain embodiments, central member 36 may be a plate formed of a resilient material such as polyurethane (PU). Central member 36 may also be formed of ethyl vinyl acetate (EVA), rubber, thermoplastic polyurethane (TPU), polyether-block co-polyamide polymers (sold as Pebax® by ATOFINA Chemicals of Philadelphia, Pa.), nylon or carbon. Central member 36 may also include a fluid-filled bladder filled with air or any other suitable fluid. Top plate 32 may be formed of a polyether-block co-polyamide polymer, thermoplastic polyurethane (TPU), or a glass-filled nylon, for example. Bottom plate 34 may be formed of a polyether-block co-polyamide polymer, TPU, a plastic such as Acrylonitrile Butadiene Styrene (ABS) or a glass-filled nylon, for example.

Central member 36 includes a plurality of elastomeric support columns 38. Elastomeric support columns 38 may be positioned about a periphery of central member 36 as seen here. It is to be appreciated that any desired number of elastomeric support columns 38 may be provided in support assembly 30, and that they may be positioned at any desired location within support assembly 30.

In the illustrated embodiment, in which support assembly is positioned only in heel portion 28, central member 36 includes four elastomeric support columns 38, with two support columns positioned on medial side 16 and two support columns positioned on lateral side 18.

In certain embodiments, elastomeric support columns 38 may have a central aperture 40 formed therein, which serves to alter the performance and support characteristics of the columns. It is to be appreciated that the diameter of aperture 40 can be varied to optimize the performance of elastomeric support columns 38.

Figure 3:
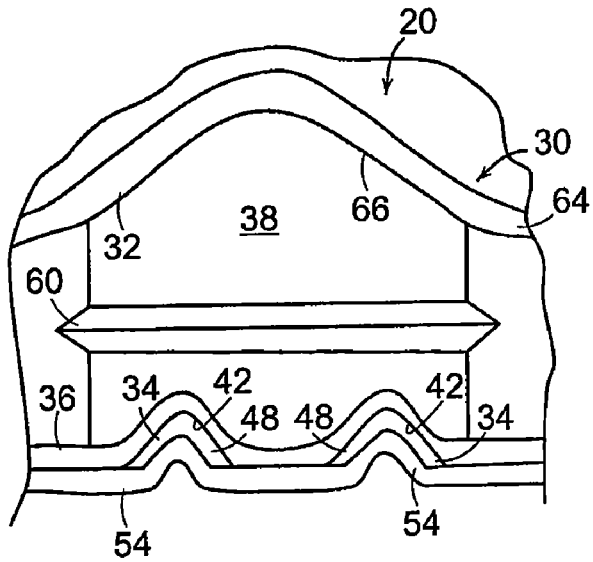
FIG. 3 is an elevation view of a portion of an alternative embodiment of the support assembly of FIG. 1.

As depicted in FIGS. 1-3, elastomeric support columns 38 have a generally cylindrical configuration. It is to be appreciated, however, that elastomeric support columns 38 may have a variety of other columnar configurations including oval, pyramidal, cubic, conic, or any other regular geometric shape. In addition to regular shapes, elastomeric support columns 38 may have an irregular geometric shape. Accordingly, elastomeric support columns 38 may have a variety of configurations that perform the functions described herein. Suitable materials for elastomeric support columns 38 include rubber, polyurethane foam, microcellular elastomeric foams, or phylon (EVA foam). Other suitable materials for elastomeric support columns 38 will become readily apparent to those skilled in the art, given the benefit of this disclosure.

A plurality of indentations 42 are formed in the lower surface 44 of central member 36. As illustrated here, indentations 42 are positioned about a periphery of central member 36. More specifically, two (2) indentations 42 are positioned along medial edge 16 of central member 36 and two (2) indentations 42 are positioned along lateral edge 18 of central member 36. Each indentation 42 extends upwardly into a corresponding elastomeric support column 38, thereby making the height of each elastomeric support column 38 shorter where indentation 42 is positioned. Elastomeric support columns 38 are consequently stiffer in the areas where their height is reduced. In the illustrated embodiment, indentations 42 have a substantially inverted V-shaped profile and extend partly into central member 36. Indentations 42 decrease in height from a maximum height at their outer edge at the periphery of central member 36 inwardly along their length to their inner edge in the interior of central member 36. An upwardly extending flange 46 is provided at a rear of central member 36. It is to be appreciated that indentations 42 may have profiles with other shapes in different embodiments.

A plurality of first raised portions 48 are provided in bottom plate 34. In the illustrated embodiment, first raised portions 48 have a substantially inverted V-shaped profile and extend partly into bottom plate 34. As illustrated here, first raised portions 48 are positioned about a periphery of bottom plate 34. More specifically, two (2) first raised portions 48 are positioned along medial edge 16 of bottom plate 34 and two (2) first raised portions 48 are positioned along lateral edge 18 of bottom plate 34. First raised portions 48 decrease in height from a maximum height at their outer edge at the periphery of bottom plate 34 inwardly along their length to their inner edge in the interior of bottom plate 34. When support assembly 30 is in its assembled condition, each raised portion 48 extends upwardly into and is nested within a corresponding indentation 42 of central member 36. It is to be appreciated that raised portions 48 may have profiles with other shapes in different embodiments.

An upwardly extending flange 50 is provided at a rear of bottom plate 34, and abuts the rear surface of flange 46 of central member 36 when support assembly 30 is in its assembled condition.

Outsole 22 is positioned beneath bottom plate 34. In the embodiment illustrated in FIG. 2, outsole 22 extends substantially only along the length of support assembly 30. It is to be appreciated that outsole 22 may extend along substantially the entire length of footwear 10, as seen in FIG. 1.

A plurality of second raised portions 54 are provided in outsole 22. Second raised portions 54 have a substantially inverted V-shaped profile and extend partly into outsole 22. As illustrated here, second raised portions 54 are positioned about a periphery of outsole 22. More specifically, two (2) second raised portions 54 are positioned along medial edge 16 of outsole 22 and two (2) second raised portions 54 are positioned along lateral edge 18 of outsole 22. Each raised portion 54 has a substantially inverted V-shaped profile and extends partly into outsole 22. Second raised portions 54 decrease in height from a maximum height at the periphery of outsole 22 inwardly along their length toward the interior of outsole 22. When support assembly 30 is in its assembled condition, each raised portion 54 of outsole 22 extends upwardly into and is nested within a corresponding raised portion 48 of bottom plate 34.

Indentations 42, raised portions 48 and 54 combine to create flex points 55 that assist with foot strike transition from heel to toe. They also help the perimeter of footwear 10 adapt more easily to edge loading, and improve lateral transition.

The specific location and size of indentations 42 and, correspondingly, raised portions 48 and 54, can be optimized to provide enhanced support and performance in a desired portion of footwear 10. Thus, certain indentations 42, along with their corresponding raised portions 48, 54 could be higher in certain portions of footwear 10 while lower in others, or wider in certain portions while narrower in others. By altering the location and size of the individual indentations 42 and the corresponding raised portions 48, 54, footwear 10 can be optimized for particular performance requirements, athletic activities or individual physiological needs.

Indentations 42, and raised portions 48, 54 also serve to enhance performance by reducing the tendency of elastomeric support columns 38 to move outwardly upon the application of shear forces. Flex points 55 act as wedges or chocks beneath elastomeric support columns 38, reducing the movement of the columns. Additionally, as noted above, elastomeric support columns 38 are shorter and, consequently, more rigid or stiffer in the areas where their indentations 42 are positioned. The increased rigidity and stiffness from this configuration may allow a softer foam or other material to be used for elastomeric support columns 38, resulting in a softer cushioned feel for the user.

An upwardly extending flange 56 is provided at a rear of outsole 22, and abuts the rear surface of flange 46 of central member 36, with flange 50 of bottom plate 34 sandwiched between flange 56 and flange 46 when support assembly 30 is in its assembled condition. These flanges provide additional support and lateral stability for footwear 10.

In certain embodiments, a circumferential groove 58 is formed in an exterior surface of each elastomeric support column. Each of a plurality of rings 60 is received in a corresponding groove 58. The engagement of rings 60 within grooves 58 serves to constrain elastomeric support columns 38 as they compress. The performance of elastomeric support columns 38 can be optimized for particular activities or design parameters by varying the size, location and type of material of rings 60 and/or the size and/or location of grooves 58. In the illustrated embodiment, each ring 60 has a substantially triangular cross section, with a base 62 of its shape forming the innermost surface of ring 60, which engages the base of a corresponding groove 58.

Rings 60 may be formed of a polyether-block co-polyamide polymer, TPU, ABS or a glass-filled nylon, for example.

A plurality of upwardly extending flanges 64 are positioned about a periphery of top plate 32. Each flange 64 has a recess 66 formed in its exterior surface, with a portion of each elastomeric support column 38 being received in a recess 66 of a corresponding flange 64 when support assembly 30 is in its assembled condition. Similarly flange 46 of central member 36 is received in a recess 66 of a corresponding flange 64 when support assembly 30 is in its assembled condition. Recesses 66 in flanges 64 serve to enhance the assembly of support assembly 30, assisting with the alignment or registration of the different components of support assembly 30.

In certain embodiments, as seen in FIG. 3, more than one indentation 42 in central member 36 can extend upwardly into an individual elastomeric support column 38. As illustrated here, two indentations 42 that are formed in central member 38 extend upwardly into a single elastomeric support column 38. Two corresponding first raised portions 48 are formed in bottom plate 34, each of which is nested in a corresponding indentation 42. Similarly, each of a pair of second raised portions 54 in outsole 22 is nested in a corresponding raised portion 48. Configuring support assembly 30 with multiple indentations and corresponding raised portions provides additional resistance to shear forces, thereby allowing increased optimization of the performance of support assembly 30.

Although the embodiment illustrated in FIG. 3 shows two indentations 42 extending upwardly into one elastomeric support column 38, along with two corresponding first raised portions 48 and second raised portions 54, it is to be appreciated that more than two indentations, and corresponding raised portions, can extend upwardly into any particular elastomeric support column. Additionally, it is to be noted that certain elastomeric support columns 38 may have no corresponding indentations 42 extending upwardly therein. Thus, it can be seen that any combination of elastomeric support columns 38 with none, one, or multiple indentations 42 extending upwardly therein can be provided.

Figure 4:
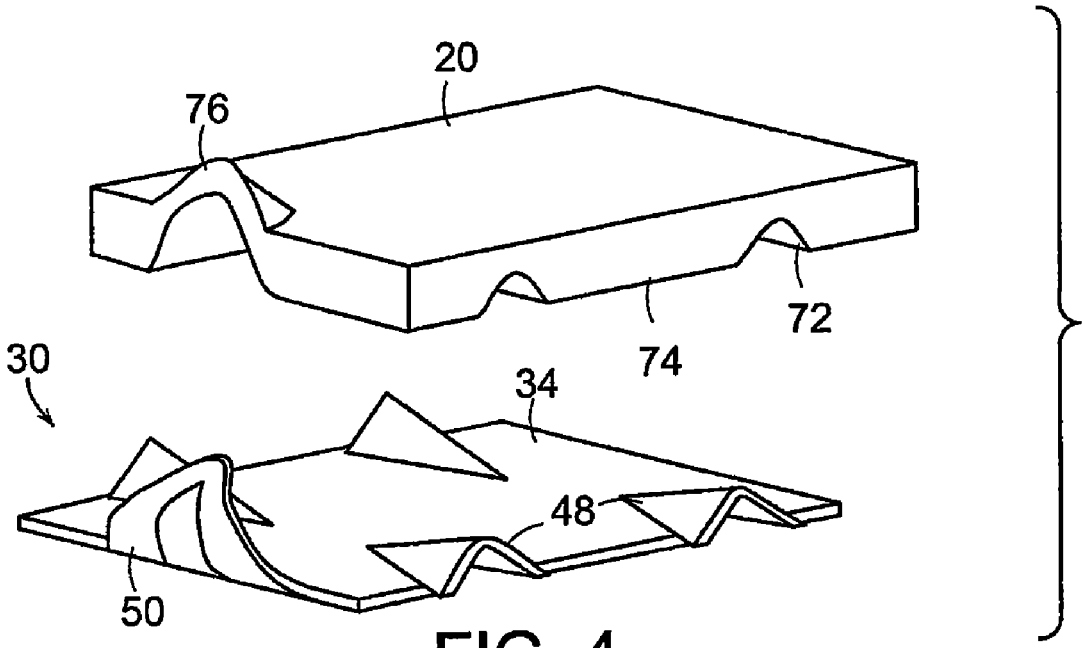
FIG. 4 is a perspective view in exploded form of an alternative embodiment of the support assembly of the article of footwear of FIG. 1.

Another embodiment is seen in FIG. 4, in which bottom plate 34 of support assembly 30 is positioned beneath midsole 20. A plurality of indentations 72 are formed in the lower surface 74 of midsole 20. As illustrated here, indentations 72 are positioned about a periphery of midsole 20. As discussed above, any number of indentations 72 can be formed in midsole 20 at any desired position. Indentations 72 have a substantially inverted V-shaped profile and extend partly into midsole 20. Indentations 72 decrease in height from a maximum height at their outer edge at the periphery of midsole 20 inwardly along their length to their inner edge in the interior of midsole 20. An upwardly extending flange 76 is provided at a rear of midsole 20. When support assembly 30 is in its assembled condition, each raised portion 48 extends upwardly into and is nested within a corresponding indentation 72 of midsole 20. A separate outsole (not shown) may be provided on the lower surface of lower plate 34, or lower plate 34 itself may form the ground engaging surface for footwear 10.

Figure 5:
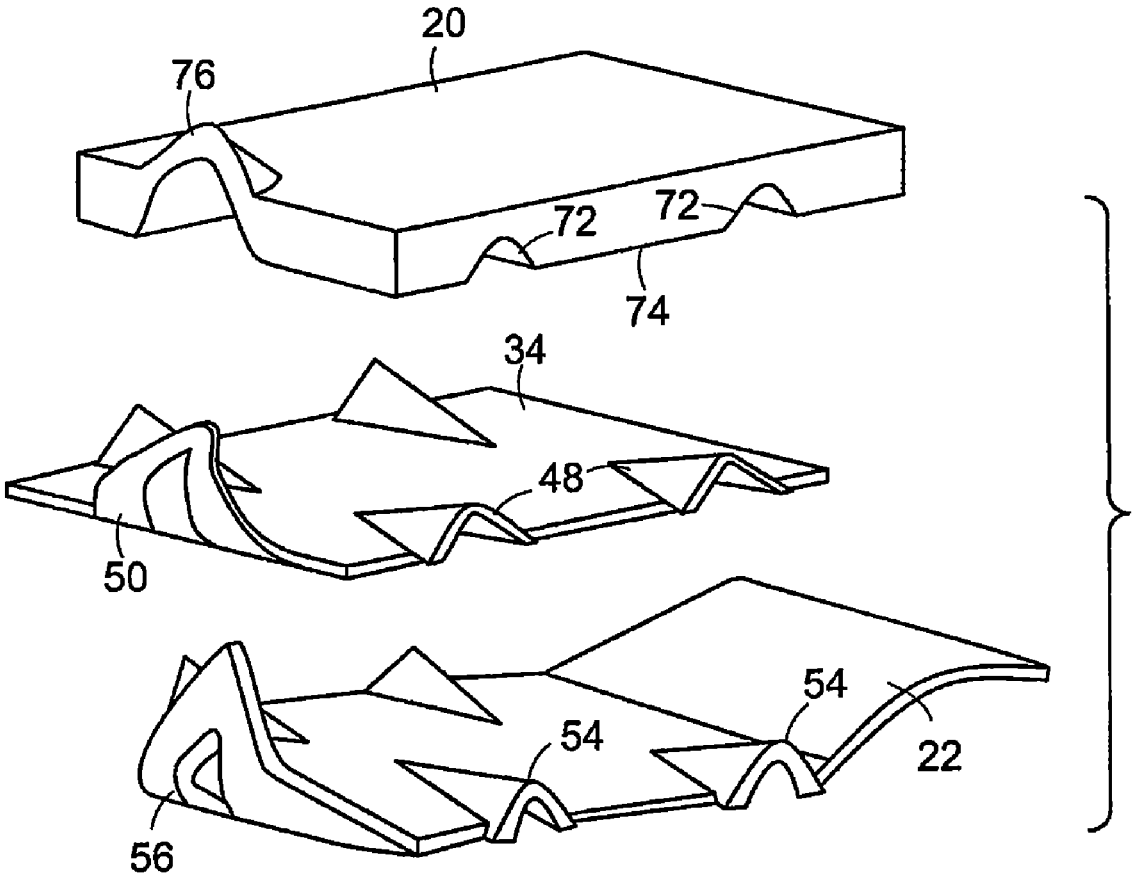
FIG. 5 is a perspective view in exploded form of another alternative embodiment of the support assembly of the article of footwear of FIG. 1.

Another embodiment is seen in FIG. 5, in which outsole 22 is positioned beneath bottom plate 34, which in turn is positioned beneath midsole 20. When support assembly 30 is in its assembled condition in this embodiment, each raised portion 54 of outsole 22 extends upwardly into and is nested within a corresponding raised portion 48 of bottom plate 34. Similarly, each raised portion 48 of lower plate 34 extends upwardly into and is nested within a corresponding indentation 72 of midsole 20.

Upwardly extending flange 56 of outsole 22 abuts the rear surface of flange 76 of midsole 20, with flange 50 of bottom plate 34 sandwiched between flange 56 and flange 76 when support assembly 30 is in its assembled condition. These flanges provide additional support and lateral stability for footwear 10.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:
an upper; and
a sole assembly secured to the upper and comprising:
a top plate;
a bottom plate spaced from the top plate;
a central member positioned between the top plate and bottom plate and including a plurality of elastomeric support columns extending upwardly from the central member;
a plurality of indentations formed in a lower surface and along a periphery of the central member, each indentation extending upwardly into an elastomeric support column; and
a plurality of first raised portions positioned along a periphery of the bottom plate, each first raised portion being nested in an indentation in the central member.

2. The article of footwear of claim 1, further comprising an outsole secured to a lower surface of the bottom plate.

3. The article of footwear of claim 2, further comprising a plurality of second raised portions positioned along a periphery of the outsole, each second raised portion of the outsole being nested in a first raised portion of the bottom plate.

4. The article of footwear of claim 2, further comprising a flange extending upwardly from a rear edge of the outsole.

5. The article of footwear of claim 1, wherein each indentation has an inverted substantially V-shaped profile.

6. The article of footwear of claim 5, wherein each indentation extends partly into an interior of the central member and has a height that decreases from a maximum value at the periphery of the central member to an inner edge of the indentation in an interior of the central member.

7. The article of footwear of claim 1, wherein each first raised portion has an inverted substantially V-shaped profile and a depth that decreases from a maximum value at the periphery of the bottom plate to a minimum value at an inner edge of the first raised portion inboard of the periphery of the bottom plate.

8. The article of footwear of claim 2, wherein each second raised portion has an inverted substantially V-shaped profile and a depth that decreases from a maximum value at the periphery of the outsole to a minimum value at an inner edge of the second raised portion inboard of the periphery of the outsole.

9. The article of footwear of claim 1, further comprising at least one ring, each ring disposed about a periphery of an elastomeric support column.

10. The article of footwear of claim 9, further comprising a circumferential groove formed in at least one elastomeric support column, each circumferential groove receiving a ring.

11. The article of footwear of claim 1, further comprising a plurality of upwardly extending flanges positioned about a periphery of the top plate.

12. The article of footwear of claim 11, wherein each flange includes a recess in a lower surface thereof, each recess receiving a portion of an elastomeric support column.

13. The article of footwear of claim 1, wherein each elastomeric support column includes a central aperture formed therein.

14. The article of footwear of claim 1, further comprising a flange extending upwardly from a rear edge of the central member.

15. The article of footwear of claim 1, further comprising a flange extending upwardly from a rear edge of the lower plate.

16. An article of footwear comprising, in combination:

an upper;

a sole assembly secured to the upper and comprising:

a top plate;

a bottom plate spaced from the top plate;

a central member positioned between the top plate and bottom plate and including a plurality of elastomeric support columns, each elastomeric support column having a circumferential groove formed in its exterior surface;

a plurality of rings, each ring seated in a corresponding circumferential groove;

a plurality of indentations formed in a lower surface and along a periphery of the central member, each indentation extending upwardly into an elastomeric support column; and a plurality of first raised portions positioned along on a periphery of the bottom plate, each first raised portion being nested in an indentation in the central member;

an outsole secured to a lower surface of the bottom plate; and a plurality of second raised portions positioned along a periphery of the outsole, each second raised portion of the outsole being nested in a raised portion of the bottom plate.

17. The article of footwear of claim 16, wherein each indentation has an inverted substantially V-shaped profile.

18. The article of footwear of claim 16, wherein each indentation extends partly into an interior of the central member and has a height that decreases from a maximum value at the periphery of the central member to an inner edge of the indentation in an interior of the central member.

19. The article of footwear of claim 16, wherein each first raised portion has an inverted substantially V-shaped profile and a depth that decreases from a maximum value at the periphery of the bottom plate to a minimum value at an inner edge of the first raised portion inboard of the periphery of the plate.

20. The article of footwear of claim 16, wherein each second raised portion has an inverted substantially V-shaped profile and a depth that decreases from a maximum value at the periphery of the outsole to a minimum value at an inner edge of the second raised portion inboard of the periphery of the outsole.

21. The article of footwear of claim 16, further comprising a plurality of upwardly extending flanges positioned about a periphery of the top plate.

22. The article of footwear of claim 21, wherein each flange includes a recess in a lower surface thereof, each recess receiving a portion of an elastomeric support column.

23. The article of footwear of claim 16, wherein each elastomeric support column includes a central aperture formed therein.

24. The article of footwear of claim 16, further comprising a flange extending upwardly from a rear edge of the outsole.

25. The article of footwear of claim 16, further comprising a flange extending upwardly from a rear edge of the central member.

26. The article of footwear of claim 16, further comprising a flange extending upwardly from a rear edge of the lower plate.

27. An article of footwear comprising, in combination:

an upper;

a sole assembly secured to the upper and comprising:

a top plate having a plurality of upwardly extending flanges positioned about a periphery thereof, each flange including a recess in a lower surface thereof;

a bottom plate spaced from the top plate and a flange extending upwardly from a rear edge thereof;

a central member positioned between the top plate and bottom plate and including a plurality of elastomeric support columns and a flange extending upwardly from a rear edge thereof, each elastomeric support column having a circumferential groove formed in its exterior surface, an upper portion of each elastomeric support column being received in a recess of the top plate;

a plurality of rings, each ring seated in a corresponding circumferential groove;

a plurality of indentations formed in a lower surface and along a periphery of the central member, each indentation extending upwardly into an elastomeric support column; and a plurality of first raised portions positioned along a periphery of the bottom plate, each first raised portion being nested in an indentation in the central member;

an outsole secured to a lower surface of the bottom plate and having a flange extending upwardly from a rear edge thereof; and a plurality of second raised portions positioned along a periphery of the outsole, each second raised portion of the outsole being nested in a raised portion of the bottom plate.

28. The article of footwear of claim 27, wherein each elastomeric support column includes a central aperture formed therein.

29. The article of footwear of claim 27, wherein each indentation has an inverted substantially V-shaped profile.

30. The article of footwear of claim 27, wherein each indentation extends partly into an interior of the central member and has a height that decreases from a maximum value at the periphery of the central member to an inner edge of the indentation in an interior of the central member.

31. The article of footwear of claim 27, wherein each first raised portion has an inverted substantially V-shaped profile and a depth that decreases from a maximum value at the periphery of the bottom plate to a minimum value at an inner edge of the first raised portion inboard of the periphery of the plate.

32. The article of footwear of claim 27, wherein each second raised portion has an inverted substantially V-shaped profile and a depth that decreases from a maximum value at the periphery of the outsole to a minimum value at an inner edge of the second raised portion inboard of the periphery of the outsole.

33. An article of footwear comprising, in combination:

an upper; and a sole assembly secured to the upper and comprising:

a midsole;

a plurality of indentations formed in a lower surface and along a periphery of the midsole;

a bottom plate positioned beneath the midsole; and a plurality of raised portions positioned along a periphery of the bottom plate, each raised portion being nested in an indentation in the midsole.

34. The article of footwear of claim 33, wherein the bottom plate is an outsole.

35. The article of footwear of claim 33, wherein each indentation has an inverted substantially V-shaped profile.

36. The article of footwear of claim 35, wherein each indentation extends partly into an interior of the midsole and has a height that decreases from a maximum value at the periphery of the midsole to an inner edge of the indentation in an interior of the midsole.

37. The article of footwear of claim 33, wherein each raised portion has an inverted substantially V-shaped profile and a depth that decreases from a maximum value at the periphery of the bottom plate to a minimum value at an inner edge of the raised portion inboard of the periphery of the bottom plate.

38. An article of footwear comprising, in combination:

an upper; and a sole assembly secured to the upper and comprising:

a midsole;

a plurality of indentations formed in a lower surface and along a periphery of the midsole;

a bottom plate positioned beneath the midsole;

a plurality of first raised portions positioned along a periphery of the bottom plate, each raised portion being nested in an indentation in the midsole;

an outsole positioned beneath the bottom plate;

a plurality of second raised portions positioned along a periphery of the outsole, each second raised portion being nested in a first raised portion in the midsole.

39. The article of footwear of claim 38, wherein each indentation has an inverted substantially V-shaped profile.

40. The article of footwear of claim 39, wherein each indentation extends partly into an interior of the midsole and has a height that decreases from a maximum value at the periphery of the midsole to an inner edge of the indentation in an interior of the midsole.

41. The article of footwear of claim 38, wherein each first raised portion has an inverted substantially V-shaped profile and a depth that decreases from a maximum value at the periphery of the bottom plate to a minimum value at an inner edge of the first raised portion inboard of the periphery of the bottom plate.

42. The article of footwear of claim 38, wherein each second raised portion has an inverted substantially V-shaped profile and a depth that decreases from a maximum value at the periphery of the outsole to a minimum value at an inner edge of the second raised portion inboard of the periphery of the outsole.

* * * * *